US008608183B2

(12) United States Patent
Woo

(10) Patent No.: US 8,608,183 B2
(45) Date of Patent: Dec. 17, 2013

(54) WALKER WITH INTEGRATED ILLUMINATION MEANS AND ALARM

(76) Inventor: Kiho Woo, Fullerton, CA (US)

( * ) Notice: Subject to any disclaimer, the term of this patent is extended or adjusted under 35 U.S.C. 154(b) by 57 days.

(21) Appl. No.: 13/286,331

(22) Filed: Nov. 1, 2011

(65) Prior Publication Data

US 2013/0106070 A1 May 2, 2013

(51) Int. Cl.
*F21V 33/00* (2006.01)

(52) U.S. Cl.
USPC ..... 280/29; 280/19.1; 362/102; 362/253; 135/67

(58) Field of Classification Search
USPC ..... 280/29, 19.1; 362/102, 253; 135/67
See application file for complete search history.

(56) References Cited

U.S. PATENT DOCUMENTS

| | | | | |
|---|---|---|---|---|
| 3,442,276 | A * | 5/1969 | Morton et al. | 135/67 |
| 3,945,389 | A * | 3/1976 | Smith | 135/67 |
| D246,036 | S | 10/1977 | Thomas | |
| 4,583,080 | A * | 4/1986 | DiVito et al. | 340/815.69 |
| 5,349,340 | A * | 9/1994 | Blumenthal | 340/574 |
| 5,839,461 | A * | 11/1998 | Lambeth, Jr. | 135/72 |
| 6,463,947 | B1 | 10/2002 | Wipperfurth | |
| 6,508,580 | B2 * | 1/2003 | Collins | 362/570 |
| 7,059,738 | B1 | 6/2006 | Nobayashi | |
| 2007/0193611 | A1 | 8/2007 | Gallo | |
| 2008/0084690 | A1 | 4/2008 | Rappl | |
| 2009/0310364 | A1 | 12/2009 | Turner | |

OTHER PUBLICATIONS

Life Light Walker Light, www.mobility-aids.com.

* cited by examiner

*Primary Examiner* — Kevin Hurley
*Assistant Examiner* — Michael Stabley

(57) ABSTRACT

The walker with integrated illumination means and alarm wires an alarm and lights into at least one side of a walker. The alarm includes a panic button located adjacent onto of the handles, and upon depression shall signal an alarm via a speaker located elsewhere on said walker. The illumination means includes at least one light that is operated via an on/off switch located adjacent one of the handles. The walker with integrated illumination means and alarm may be of foldable construction or a wheeled construction. An embodiment may include illumination means located and operated on a left side of said walker, whereas another illumination means is located and operated on a right side of said walker. The illumination means and alarm are portably powered, and increase the overall weight of the walker by a negligible margin.

3 Claims, 4 Drawing Sheets

WALKER WITH INTEGRATED ILLUMINATION MEANS AND ALARM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of walkers, more specifically, a walker having illuminating means as well as an alarm.

There are a multitude of types of walkers or walking aids, which help individuals maintain some sense of mobility. A traditional walker is usually constructed of a lightweight tubular material, and forms a U-shape upon which handles are provided to enable an end user a place to grab. Those individuals who require the assistance of a walker are limited in the speed with which they walk, which makes them vulnerable to attacks. Moreover, some individuals who require the assistance of a walker may have limited or poor eyesight, which can make mobility difficult in poorly lit areas.

What is needed is an improved walker that is of a foldable construction or wheeled construction, and which operates in a normal fashion, but which includes illumination means and an alarm into the design of the walker. The device of the present application seeks to address these needs by integrating illumination means and an alarm into the construction of the walker in such a manner so as not to impact functionality of the walker.

B. Discussion of the Prior Art

As will be discussed immediately below, no prior art discloses a walker of foldable construction or wheeled construction, which includes at least one light and an alarm, which are integrated into the construction of the walker; wherein the light forms the illumination means that is operated via an on/off switch located adjacent the handle portion of the walker, whereas the alarm is operated via a panic button that is also adjacent the handle portion of the walker; wherein an embodiment of the walker is such that a left side of the walker includes illumination means operated by an on/off switch located adjacent a left handle, and a right side of the walker includes another illumination means operated by another on/off switch located adjacent a right handle.

The Nobayashi patent (U.S. Pat. No. 7,059,738) discloses a walker having a light to illuminate the ground. However, the walker is not capable of incorporating different arrays of lights forming an illumination means that can be controlled on either side of the walker, and working in conjunction with an alarm.

The Turner Patent Application Publication (U.S. Pub. No. 2009/0310364) discloses an illumination accessory for a walker. However, the accessory is not integrated into the construction of the walker, and of which does not feature an illumination means and alarm as depicted and described below. Moreover, the accessory does not provide for controlling arrays of lights located on either side or both sides of the walker.

The Rappl Patent Application Publication (U.S. Pub. No. 2008/0084690) discloses a universal headlight for attachment to a walker. Again, the headlight is an accessory that clips onto an existing walker, and is not integrated into the construction of the walker for use in conjunction with an alarm. Moreover, the accessory does not provide for controlling arrays of lights located on either side or both sides of the walker.

The Wipperfurth patent (U.S. Pat. No. 6,463,947) discloses a directionally illuminated walking aid, such as a walker. Again, the illuminated walking aid is not used in conjunction with an alarm. Moreover, the illuminated walking aid does not provide for controlling arrays of lights located on either side or both sides of the walker.

The Gallo Patent Application Publication (U.S. Pub. No. 2007/0193611) discloses an illuminated convalescent walker. Again, the walker does not include an alarm working in conjunction with an illumination means that is operable to directing light to either or both sides of the walker.

The Thomas patent (U.S. Pat. No. Des. 246,036) illustrates a design for a folding walker. However, the folding walker does not illustrates an illumination means and/or alarm built into the construction of the walker.

The Life Light Walker Light, a non-patent piece, of prior art located at www.mobility-aids.com, discloses a light attachable onto a tubular construction for use with a walker or a wheelchair. However, the light is not integrated into the design and construction of the walker, or include an alarm as well.

While the above-described devices fulfill their respective and particular objects and requirements, they do not describe a walker of foldable construction or wheeled construction, which includes at least one light and an alarm, which are integrated into the construction of the walker; wherein the light forms the illumination means that is operated via an on/off switch located adjacent the handle portion of the walker, whereas the alarm is operated via a panic button that is also adjacent the handle portion of the walker; wherein an embodiment of the walker is such that a left side of the walker includes illumination means operated by an on/off switch located adjacent a left handle, and a right side of the walker includes another illumination means operated by another on/off switch located adjacent a right handle. In this regard, the walker with integrated illumination means and alarm departs from the conventional concepts and designs of the prior art.

SUMMARY OF THE INVENTION

The walker with integrated illumination means and alarm wires an alarm and lights into at least one side of a walker. The alarm includes a panic button located adjacent onto of the handles, and upon depression shall signal an alarm via a speaker located elsewhere on said walker. The illumination means includes at least one light that is operated via an on/off switch located adjacent one of the handles. The walker with integrated illumination means and alarm may be of foldable construction or a wheeled construction. An embodiment may include illumination means located and operated on a left side of said walker; whereas another illumination means is located and operated on a right side of said walker. The illumination means and alarm are portably powered, and increase the overall weight of the walker by a negligible margin.

It is an object of the invention to provide a walker with lights and an alarm into the construction of the walker, and with a negligible increase as to overall weight.

A further object of the invention is to provide a walker of foldable construction or wheeled construction, which includes the illumination means and alarm therein.

A further object of the invention is to provide a walker in which the illumination means is split into two different illumination means that are specific to the left side of the walker and to the right side of the walker.

A further object of the invention is to incorporate on/off switches and panic buttons adjacent the handle portions of the walker so as to provide close proximity to the hands, of the end user while minimizing the ability to balance one self when in need of the illumination means or the alarm.

A further object of the invention is to provide an illumination means and the alarm with powering means that are portable.

A further object of the invention is to provide a speaker for use with the panic button that is directed rearwards with respect to the direction of the walker in order to alert individuals from behind the end user.

A further object of the invention is to provide an illumination means that may include multiple lights at multiple locations and elevations across a front portion of the walker.

These together with additional objects, features and advantages of the walker with integrated illumination means and alarm will be readily apparent to those of ordinary skill in the art upon reading the following detailed description of presently preferred, but nonetheless illustrative, embodiments of the walker with integrated illumination means and alarm when taken in conjunction with the accompanying drawings.

In this respect, before explaining the current embodiments of the walker with integrated illumination means and alarm in detail, it is to be understood that the walker with integrated illumination means and alarm is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the walker with integrated illumination means and alarm.

It is therefore important that the claims be regarded as including such equivalent construction insofar as they do not depart from the spirit and scope of the walker with integrated illumination means and alarm. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A walker with integrated illumination means and alarm 100 (hereinafter invention) includes a walker 101 of standard construction, and which includes an illumination means 110 and an alarm 120 therein and thereon.

Figure 4:
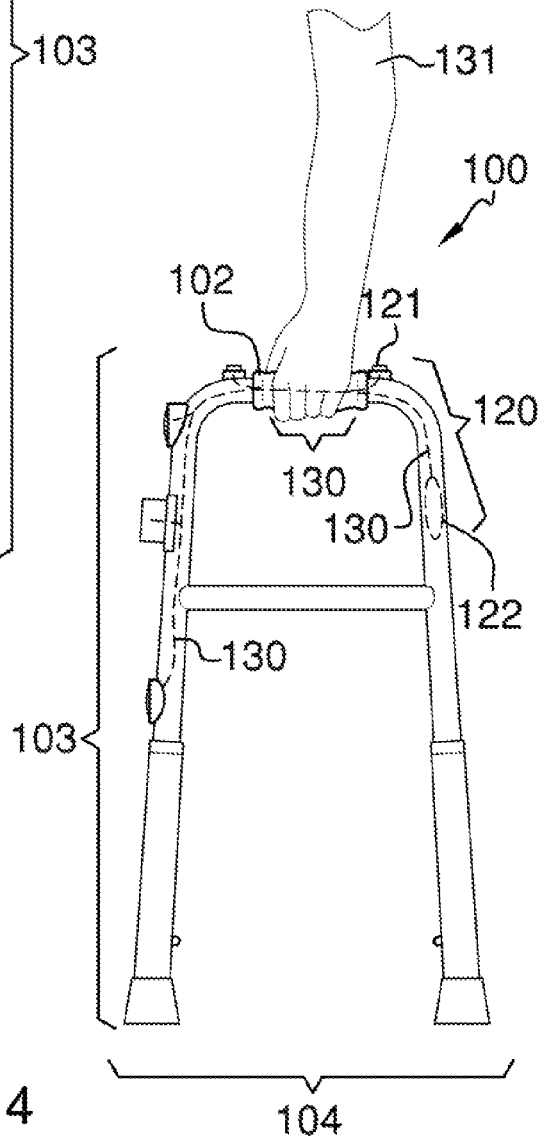
FIG. 4 illustrates a right side view of the walker with integrated illumination means and alarm in which detail is provided as to the wiring for the illumination means and alarm.
Figure 5:
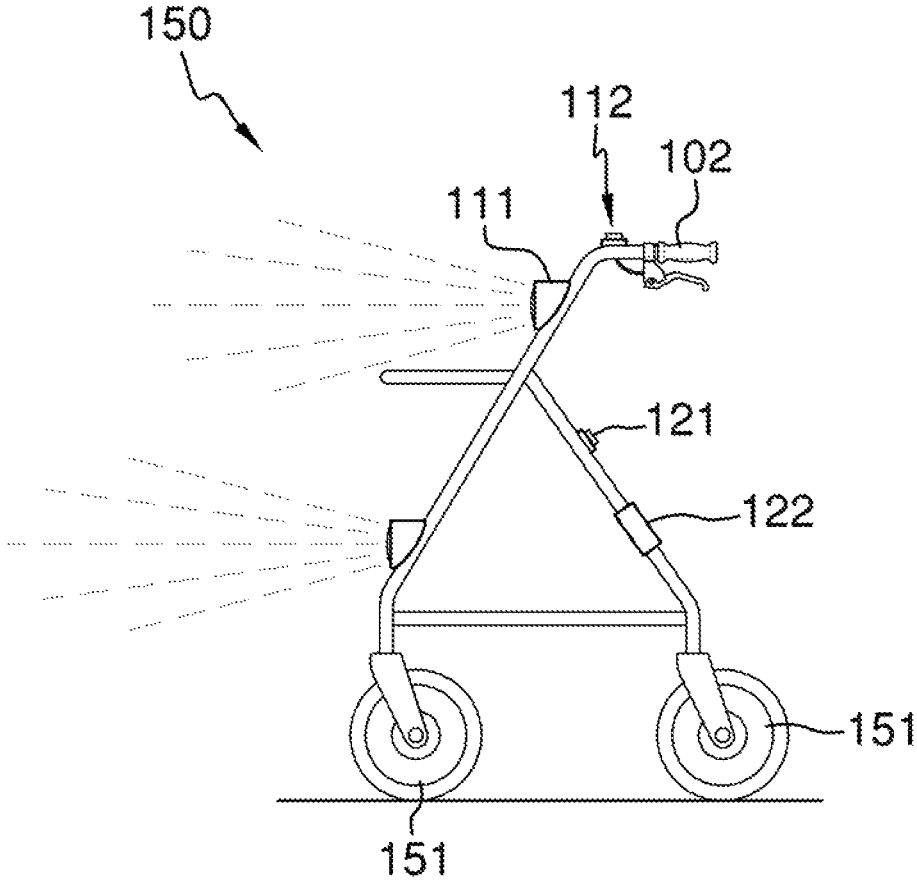
FIG. 5 illustrates a side view of a wheeled walker in which detail is provided as to the light emitted via the multiple lights at varying elevations along a front portion of said walker.

The walker 101 may be of various types comprising the foldable construction (FIG. 1-4) and/or the wheeled construction (see FIG. 5). Moreover, the walker 101 is further defined with handles 102, a front portion 103, a left side 104, and a right side 105. The walker 101 shall be made of components of tubular or hollow construction in order to facilitate interconnection of the various components comprising the illumination means 110 and the alarm 120.

Referring to FIGS. 1-4, the illumination means 110 is constructed of a plurality of lights 111 that are integrated into the front portion 103 of the walker 101. More specifically, the lights 111 are located at varying elevations on the front portion 103, and comprising an upper array 111A and a lower array 111B. It shall be noted that the lights 111 shall be further defined as being located on the left side 104 as well as on the right side 105.

The illumination means 110 includes at least one on/off switch 112 that is located adjacent one of the handles 102 of the walker 101. The location of the on/off switch 112 is important to the overall function of the invention 100 as it is desirable to minimize the travel of a hand 130 of an end user 131 from the handle 102 when in use with the walker 101

It shall be noted that the invention 100 may employ the on/off switch 112 adjacent each handle 102. More specifically, the on/off switch 112 located on the left side 104 shall be responsible for operation of the lights 111 located on the left side 104 of the walker 101; whereas the on/off switch 112 located on the right side 105 shall be responsible for operation of the lights 111 located on the right side 105 of the walker 101.

Wiring 130 is provided within the construction of the walker 101, and is responsible for the inter-connectivity of the various components comprising the illumination means 110 and the alarm 120.

The invention 100 shall include a powering means 140. The powering means 140 shall be integrated into the construction of the walker 101. The powering means 140 may be comprised of at least one battery, which may be further rechargeable. The powering means 140 shall be in wired communication with the wiring 130 in order to provide power necessary for operation of the illumination means 110 and the alarm 120.

Figure 3:
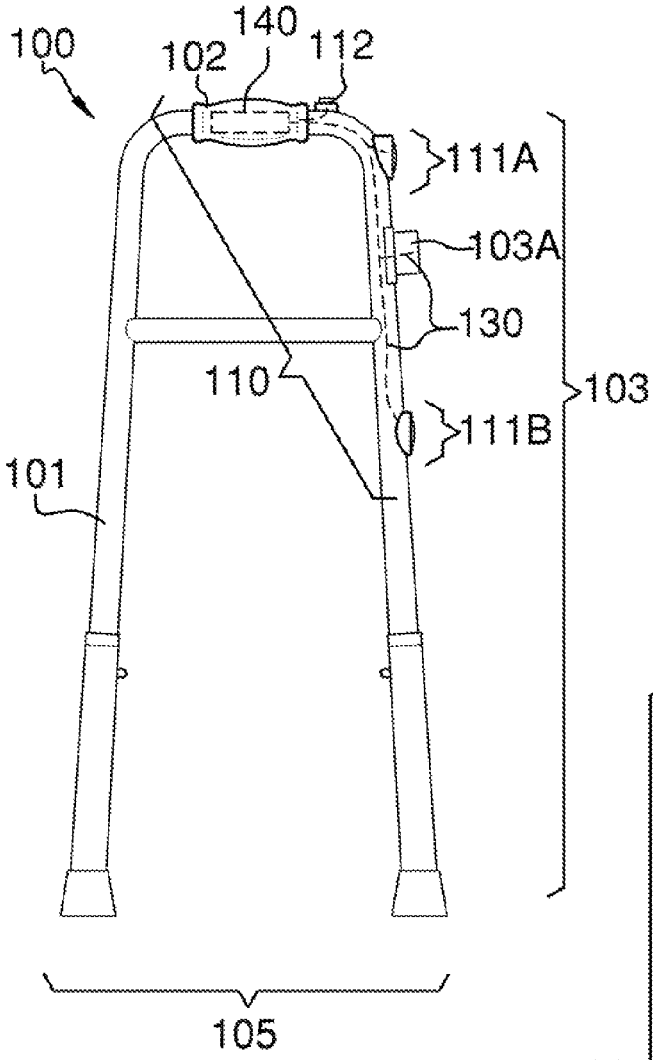
FIG. 3 illustrates a left side view of the walker with integrated illumination means and alarm in which detail is provided as to the powering means and wiring integrated within the construction of the walker.

Referring to FIG. 3, it shall be noted that the powering means 140 is located within one of the two handles 102 of the walker 101. More specifically, the powering means 140 is located within the handle 102 located on the right side 105 of the walker 101. It shall be noted that the location of the powering means 140 within the construction of the walker 101 shall not be operative in determining patentability, and is hereby otherwise an obvious consideration. More the point, the powering means 140 may be located elsewhere within the walker 101 provided the location does not impede functionality of the walker 101.

Referring to FIGS. 1-4, the alarm 120 is comprised of a panic button 121 that is located adjacent one of the handles 102 of the walker 101. The panic button 121 is in wired communication with the powering means 140 and a speaker 122 via the wiring 130. The speaker 122 is directed rearwardly with respect to the walker 101, and emits a high-decibel alarm upon depression of the panic button 121.

Referring to FIG. 4, it shall be noted that wiring 130 extends across a front rail 103A of the front portion 103 of the walker 101 in order to provide inter-connectivity of components of the illumination means 110 opposite of the side of the walker 101 bearing the powering means 140. More specifically, the wiring 130 enables the powering means 140 located on the right side 105 to power the lights 111 via the on/off switch 112 located on the left side 104.

Figure 1:
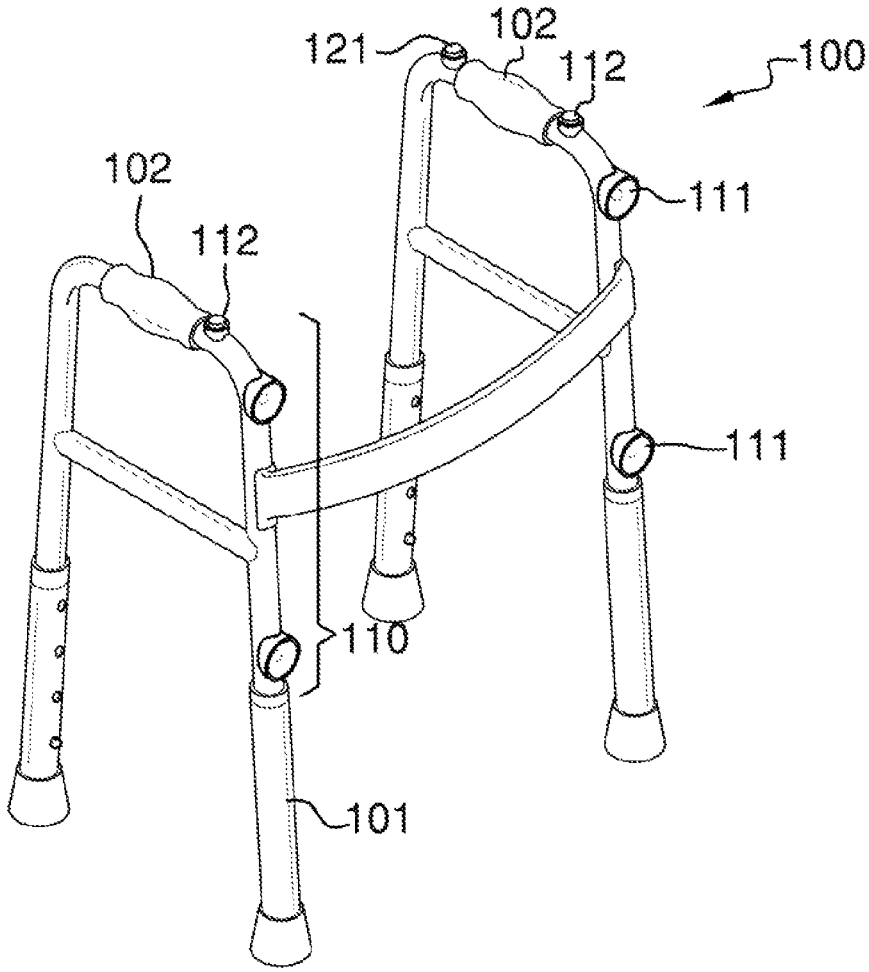
FIG. 1 illustrates a perspective view of the walker with integrated illumination means and alarm wherein the walker is of a foldable construction, and detail is provided as to the multiple locations as well as the multiple elevations of the lights provided along the front portion of the walker.
Figure 2:
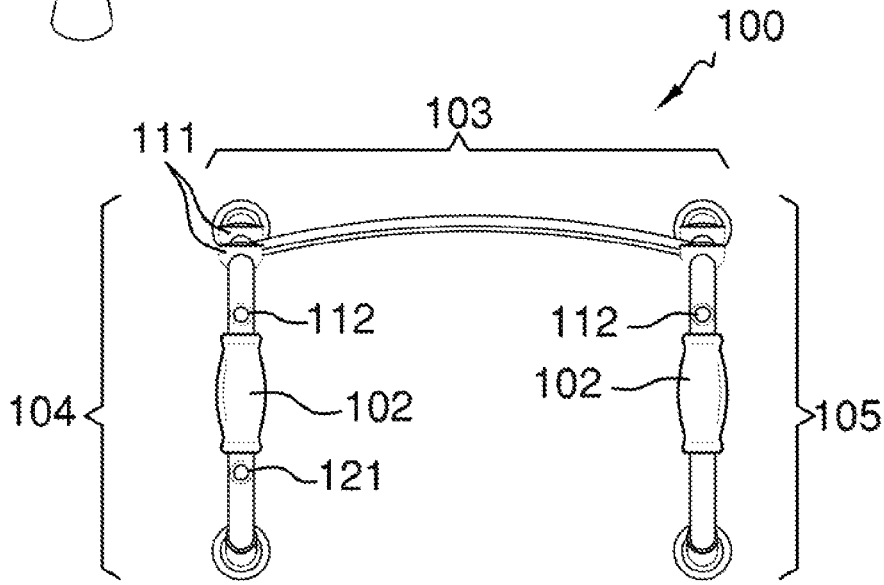
FIG. 2 illustrates a top view of the walker with integrated illumination means and alarm wherein detail is provided as to the location of the on/off switches as well as the panic button adjacent the handles.
Figure 1A:
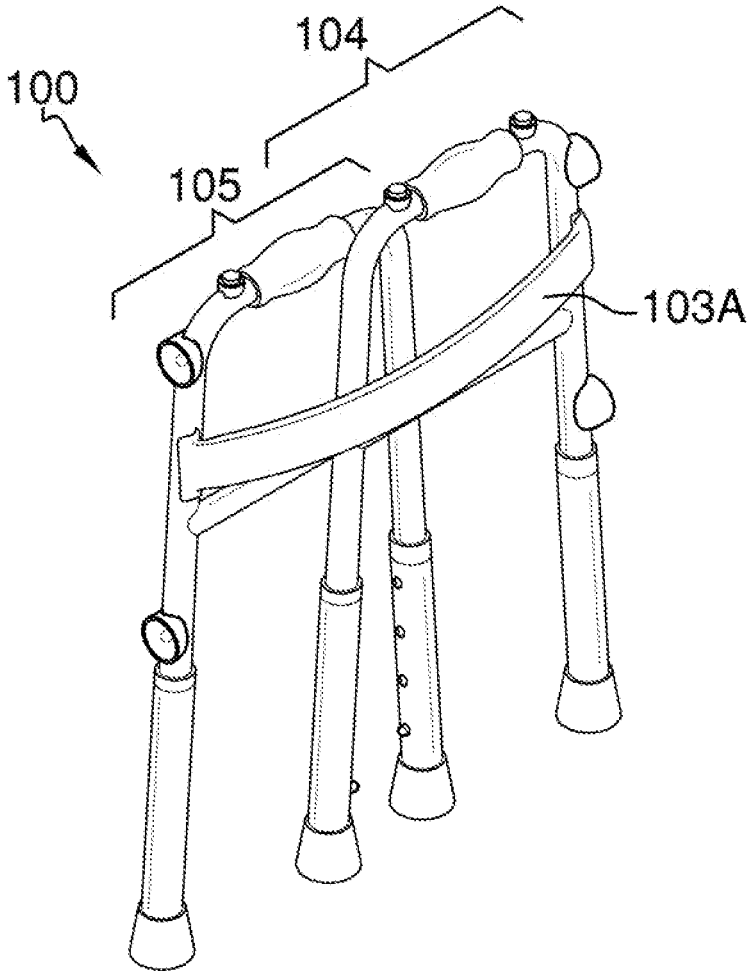
FIG. 1A illustrates a perspective view of the walker folded up when not in use.
Figure 2A:
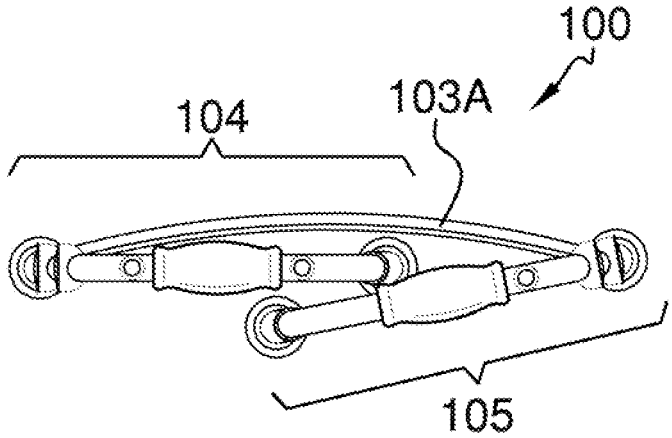
FIG. 2A illustrates a perspective view of the walker folded up when not in use.

Referring to FIGS. 1A and 2A, the walker 101 is of the foldable kind, and meaning that the left side 104 of the walker 101 is capable of folding to a generally parallel or an acute orientation with the front rail 103A of the front portion 103. Moreover, the right side 105 of the walker 101 is capable of folding to an acute or a generally parallel orientation with the front rail 103A of the front portion 103.

Referring to FIG. 5, the invention 100 may be adapted for a wheeled walker 150, and that wheels 151 enable laminar movement of the wheeled walker 150. The lights 111 of the illumination means 110 and the alarm 120 and components therein and therewith shall be in generally respective locations as with the invention 100 mentioned above.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

While the embodiments of the invention have been disclosed, certain modification may be made by those skilled in the art to modify the invention without departing from the spirit of the invention.

The invention claimed is:

1. A walker with integrated illumination means and alarm comprising:

a walker in which an illumination means provides a plurality of lights along a front portion of said walker, and which are in wired communication with an on/off switch;

wherein an alarm is integrated into said walker and includes a panic button that emits an alarm via a speaker in wired communication;

wherein powering means is in wired communication with the illumination means and the alarm;

wherein the lights are located at varying elevations along the front portion of the walker, and comprising an upper array and a lower array;

wherein the lights are further defined as being located on a right side of the front portion and a left side of the front portion;

wherein the walker is foldable such that the left side of the walker is capable of folding to a generally parallel or an acute orientation with a front rail of the front portion; wherein the right side of the walker is capable of folding to an acute or a generally parallel orientation with the front rail of the front portion, respectively;

wherein the on/off switch is adjacent a handle of said walker;

wherein the panic button is adjacent a handle of said walker;

wherein said speaker is directed rearwardly with respect to the direction of said walker;

wherein the powering means being in wired communication with the illumination means and alarm is comprised of at least one battery;

wherein said battery is/are rechargeable.

2. The walker with integrated illumination means and alarm as described in claim 1 wherein the walker is a wheeled walker.

3. A walker with integrated illumination means and alarm comprising:

a walker in which an illumination means provides a plurality of lights along a front portion of said walker, wherein said lights are located on both a left side of said walker as well as a right side of said walker;

wherein the lights of the left side are in wired communication with an on/off switch located adjacent a handle of said left side, whereas lights of the right side are in wired communication with another on/off switch located adjacent a handle of said right side;

wherein an alarm is integrated into said walker and includes a panic button that emits an alarm via a speaker in wired communication;

wherein powering means is in wired communication with the illumination means and the alarm;

wherein the lights are located at varying elevations along the front portion of the walker, and comprising an upper array and a lower array;

wherein the lights of the left side are controlled by the on/off switch adjacent the handle of the left side, whereas the lights of the right side are controlled by the another on/off switch adjacent the handle of the right side;

wherein the panic button is adjacent a handle of said walker;

wherein said speaker is directed rearwardly with respect to the direction of said walker;

wherein the powering means being in wired communication with the illumination means and alarm is comprised of at least one battery;

wherein the walker is foldable such that the left side of the walker is capable of folding to a generally parallel or an acute orientation with a front rail of the front portion; wherein the right side of the walker is capable of folding to an acute or a generally parallel orientation with the front rail of the front portion, respectively;

wherein said battery is/are rechargeable;

wherein the walker is a wheeled walker.

* * * * *